US006151725A

United States Patent [19]

Di Stefano

[11] Patent Number: 6,151,725

[45] Date of Patent: Nov. 28, 2000

[54] HYGIENIC TOILET TANK

[76] Inventor: Alfonso Di Stefano, 1413 Wayburn Rd., Grosse Pointe Park, Mich. 48230

[21] Appl. No.: 09/189,779

[22] Filed: Nov. 10, 1998

[51] Int. Cl.[7] ..... E03D 1/34

[52] U.S. Cl. ..... 4/378; 4/390; 4/397; 4/395

[58] Field of Search ..... 4/378, 390, 396, 4/397, 391, 383, 395

[56] References Cited

U.S. PATENT DOCUMENTS

| | | | |
|---|---|---|---|
| 460,536 | 9/1891 | Keyser | 4/383 |
| 568,995 | 10/1896 | Thwaites | 4/383 |
| 580,860 | 4/1897 | Hale | 4/383 |
| 841,487 | 1/1907 | Day | 4/383 |
| 2,210,796 | 8/1940 | Crane | 4/397 |
| 3,860,972 | 1/1975 | Costello | 4/397 |
| 4,499,615 | 2/1985 | Radovsky | 4/396 |
| 5,708,991 | 1/1998 | DeMarco | 4/353 |

*Primary Examiner*—David J. Walczak
*Attorney, Agent, or Firm*—Christopher P. Maiorana, P.C.

[57] ABSTRACT

A toilet tank capable of use in combination with a toilet or commode to allow improved flushing operations. The toilet tank comprises a smooth inner surface and a formed bottom portion defining a tank evacuation hole at a base of the conical portion. A flush ball head will seat into a sealed position over the tank evacuation hole, guided by the tank walls. The flush ball may be weighted while the remaining, generally tubular flusher element may be left hollow to facilitate a generally vertical orientation of the entire flusher.

15 Claims, 2 Drawing Sheets

HYGIENIC TOILET TANK

FIELD OF THE INVENTION

The present invention relates to toilet tanks generally and, more particularly, to a hygienic toilet tank system in which the toilet tank has a tapered bottom portion with a tank evacuation hole placed at a lower base portion.

BACKGROUND OF THE INVENTION

Toilet tank systems for flushing a toilet (or commode) are typically rectangular in shape. Toilet tanks are commonly provided with a tank evacuation hole at the lower surface of the generally rectangular tank. In operation, when the toilet is to be flushed, a user actuates a trip lever (or handle) which in turn lifts a flush ball from the tank evacuation hole. The water previously held in the tank passes through the tank evacuation hole at the bottom of the tank which empties the contents of the toilet. After virtually all of the water is evacuated from the tank, the flush ball falls back into place to cover the tank evacuation hole. Water then flows back into the toilet tank through a float valve. When the water level in the tank rises to a predetermined point, the float valve seals the water inflow pipe and the toilet tank is ready for a subsequent use.

Conventional approaches implement a flush ball (or flapper) mounted to a generally vertically oriented toilet refill pipe, which is located adjacent the tank evacuation hole. The flush ball is anchored to a vertical element adjacent the tank evacuation hole. The flush ball moves radially, pivoting around its one or two points of anchor at a lower end of the pipe.

Several problems commonly arise as a result of the radial movement of the flush ball back into a sealed position over the tank evacuation hole. One problem is commonly identified as the hissing sound associated with a "leaking" tank. The leak is caused by the flush ball failing to completely seat over the tank evacuation hole. This can result when the flush ball, after radially moving back into position over the tank evacuation hole, fails to properly seat the flapper over the hole. In more egregious cases, the flush ball may not drop from a raised position after a flush, causing the tank to run continuously. In either case, if the operator does not notice the running water before walking away from the toilet, a large quantity of water may be lost before the subsequent user notices the problem.

If a user is fortunate, the problem of the hissing or running water can be alleviated by jiggling the trip lever handle. The jiggling can cause jerking of the chain located at the distal, internal end of the trip lever. The jiggling of the chain may induce the flapper ball to fall if stuck in an upright position, or to reseat over the tank evacuation hole. Otherwise, the operator may need to remove the tank lid and make appropriate adjustments by hand.

Another problem associated with the common existing tanks occurs since leaking water can be at a relatively low temperature compared to room temperature because the water continues to be replenished and thus never comes to equilibrium with room temperature. As a result, condensation of the tank commonly occurs as the humidity in the room air condenses on the cold tank walls. If this condition occurs regularly, the outside of the tank can collect mildew requiring additional effort to maintain a suitable sanitary condition. Additionally, the corners of a conventional toilet tank tend to collect mildew, which may lead to an unsanitary condition.

The objects, features and advantages of the present invention include providing a toilet tank system which may reduce or eliminate the problem of an unsealed flush ball over the tank evaluation hole and/or the collection of mildew inside the tank. The present invention may (i) reduce the overall water required to provide proper operation and (ii) reduce the buildup of mold or mildew on the inside and/or outside of the tank by providing a tank that has a formed inner surface without any corners and/or creases.

SUMMARY OF THE INVENTION

The present invention concerns a toilet tank capable of use in combination with a toilet or commode to allow improved flushing operations. The toilet tank comprises a smooth inner surface and a formed bottom portion forming a tank evacuation hole at a base of the conical portion. A flush ball head will seat into a sealed position over the tank evacuation hole, guided by the tank walls. The flush ball may be weighted while the remaining, generally tubular flusher element may be left hollow to facilitate a generally vertical orientation of the entire flusher.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The present invention concerns a toilet tank for use in combination with a toilet or commode to allow appropriate flushing operation that minimizes or eliminates the nonsealable mounting of a flush ball over the tank evacuation hole and/or the buildup of mildew on the inside of the tank. The toilet tank according to the present invention may have an angled, or shaped, bottom portion forming a tank evacuation hole at a base of the bottom portion. As a result, the flush ball head will more readily seat into a sealed position over the tank evacuation hole.

If desired, the tank can have a structure in a typical rectangular (or oval) format, with only the bottom portion formed to come to a generally circular bottom surface in which the tank evacuation hole may be placed. However, even if a rectangular top portion is used, the corners should not be abrupt to maintain a smooth inner surface. Alternatively, the toilet tank can be of a triangular front cross section with a generally rectangular (or oval) side cross section, in which case the bottom surface may be elliptical rather than circular. The present invention will continue to work with this configuration as well, so long as the flush ball head is suitably configured to match the shape of the tank evacuation hole in a sealable manner, whether the hole is circular, elliptical or otherwise. An entirely conical tank, presenting a triangular cross section in all views, would also be operative within the scope of the present invention.

In a preferred embodiment, the flush ball or flapper head may be located at one end of a flusher element. The flush ball may be weighted while the remaining, generally tubular, flusher element is left hollow to facilitate a generally vertical orientation of the entire flusher. This ensures that the weighted head will seek the lowest position in the generally conical portion of the toilet tank where the head will come to a sealing position over the tank evacuation hole. As explained above, the actual shape of the tank evacuation hole, possibly either circular or elliptical, or even of another shape, is not critical so long as the flush ball is designed in a complementary configuration to sealably mount over the tank evacuation hole.

Figure 1:
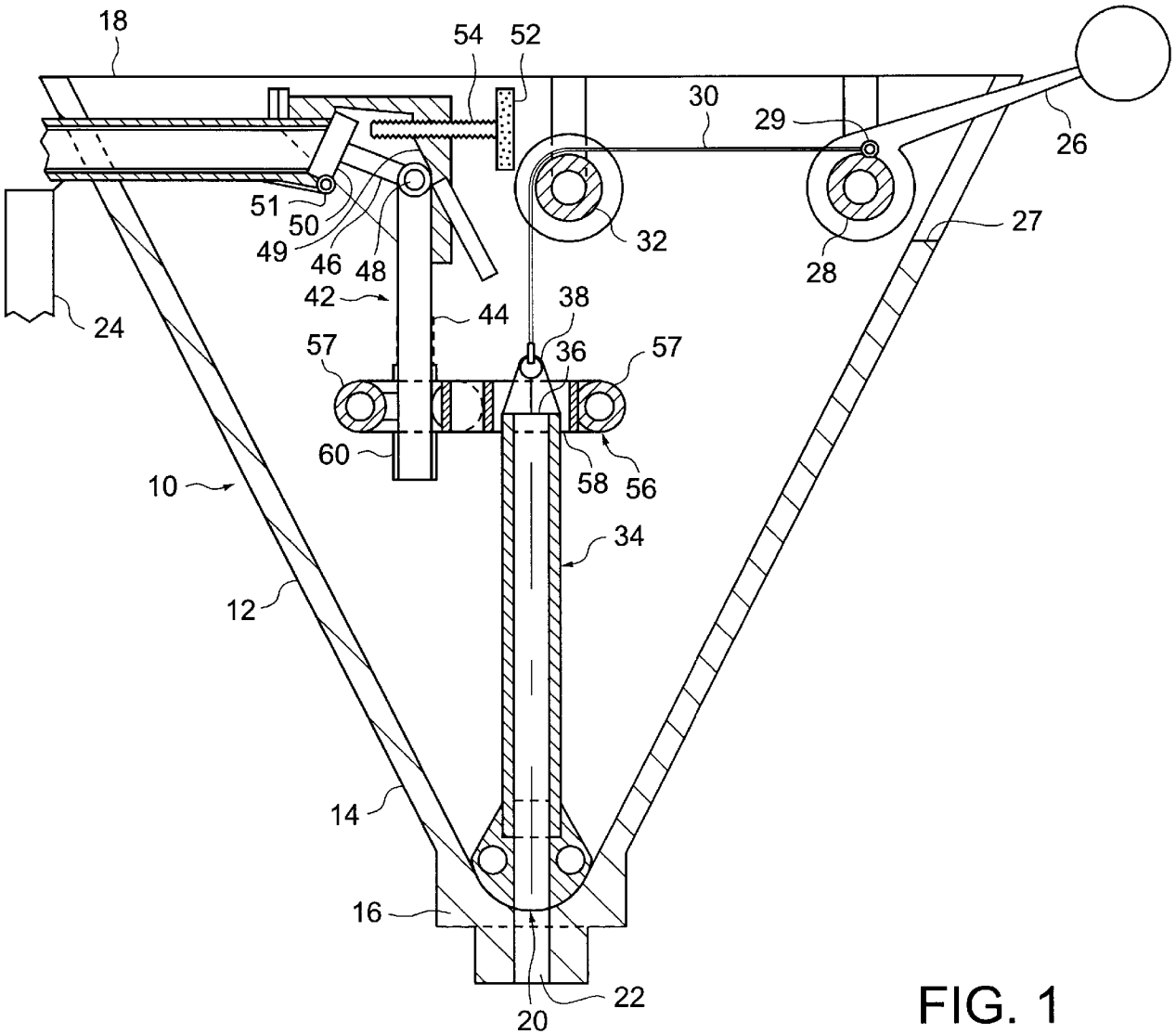
FIG. 1 is a front view of a toilet tank in accordance with preferred embodiment of the present invention.

Referring now to FIG. 1 a toilet tank 10 is shown in accordance with a preferred embodiment of the present invention. One of skill in the art will readily appreciate that other tank configurations may also be used with the present invention, as will be described below. The tank 10 generally comprises a single tank wall 12, a bottom portion 14 and a base area 16. The base 16 generally has some planar surface extending generally horizontally as the configuration of tank 10 is a truncated cone which does not actually come to a single geometric point. A tank lid 18 may be placed at a top end of the tank 10 opposite from the base 16. The lid 18 may be made in a generally complementary fashion with the planar configuration of the top section of the tank 10.

The base portion 16 may include a tank evacuation hole 20. An evacuation pipe 22 may descend from the evacuation hole 20 which leads into the toilet (or commode) in a manner common to the existing art. It will be appreciated that when the water in the tank 10 is evacuated through the tank evacuation hole 20 (and the pipe 22), the operation will cause evacuation of the contents of the toilet. The cross sectional configuration of the tank evacuation hole 20 will most commonly be either circular or elliptical. However, particular configuration of the hole 20 is not critical, so long as the flush ball head, to be described later, is configured in a complementary fashion to sealably mount over the tank evacuation hole 20. The tank 10 is configured to receive an end of an inflow water pipe 24 within the interior volume of the tank 10.

The tank 10 may also comprise a handle (or trip lever) 26, which is used by an operator to initiate the flushing of the tank 10. If desired, the handle 26 may be placed through an opening 27 in the tank wall 12. The internal end of the handle 26 is rotatably mounted on the trip lever pivot 28. The pivot 28 is permanently mounted on an interior surface of the tank 10. The interior end of the trip lever 26 is also provided with a chain anchor 29, which is connected to an end of flusher chain 30. If desired, the flush chain 30 may be mounted over a pulley 32 which is permanently mounted to an interior side of a tank wall 12. The other end of chain 30 is attached to a flusher 34. Alternatively, the handle 26 may be configured in a manner typical to the existing art.

The flusher 34 may generally be of elongated tubular shape, having generally vertical orientation. A flusher tail 38 may be mounted at an upper end of a generally elongated flusher body 36. The flusher tail 38 may be attached to the other end of flush chain 30. Since the flusher 34 is generally hollow, it also serves to provide overflow protection. When water in the tank rises above a top portion 36, it is drained through the flusher 34 to the evacuation hole 20. A flush ball or flapper head 40 may be mounted at the other lower end of the flusher body 36. The actual configuration of the flush ball 40 complements the shape of the hole 20 to ensure a sealable mount of the flush ball 40 over the hole 20. The flush ball 40 may be generally spherical in shape and configured to sealably seat against the bottom portion 14 of the tank 10 in an area which exceeds the circumference of the hole 20. In this manner, the configuration of the flush ball 40 will always serve to sealably seat over the tank evacuation hole 20 when the flusher 34 drops. The flush ball 40 also has a hollow interior to allow overflow water to pass to the tank evacuation hole 20.

The flusher 34 may be formed to ensure that the flush ball 40 will always descend in a sealable manner by weighting the flush ball 40. If desired, the flusher body 34 may be formed of a buoyant material while the weighted nature of the flush ball 40 will ensure that that end of the flusher 34 normally descends to sealably mount over the hole 20. The flush ball 40 may be weighted with a material denser than water, in an appropriate amount, to counteract the buoyancy effect of the hollow flusher 36. In this manner, the flusher 34 will be ensured of operating in a generally vertical manner as gravity forces the more dense flusher ball 40 to the bottom of the conically shaped bottom portion 14. Although not critical to the present invention, the flusher 34 and corresponding components may be unitarily formed.

The tank 10 also comprises a float 42 which has a float body 44. The float body 44 may preferably be a vertically oriented elongated member formed of a suitably buoyant material. The float 42 also includes an upper float arm 46, connected to the float body 44, through a float hinge 48. The hinge 48 may move along a curved portion 49. A float seal 50 may be formed at an upper end of the upper float arm 46, which will be configured to sealably mount against an end of the inflow water pipe 24. The float seal 50 may move about a hinge 51. The float 42 may also include a float adjustment handle 52 attached to a float adjustment stem 54 mounted on an interior portion of the tank wall 12 to facilitate the sealable floating mount of the float seal 50 against the interior end of the inflow pipe 24. The adjustment handle 52 may be used to control the flow of water into the tank 10. The adjustment handle 52 may be used to completely shut off the flow of water into the tank 10 if the toilet will not be in use for an extended period, such as a vacation.

The tank 10 may optionally include a guide 56 mounted on an interior portion of the tank wall 12. The guide 56 may be suitably positioned to facilitate the appropriate position and operation of both the flusher 34 and the float 42. The guide 56 may be mounted to the interior surface of tank wall 12 with one or more guide mounts 57, as needed. The guide 56 is provided with a flusher passage 58 through which the flusher 34 may pass in a generally vertical orientation. In a similar manner, the float passage 60 may facilitate the vertical operation of the float 42 as the float 42 descends and subsequently floats upward to selectively seal off or open the interior end of the inflow pipe 24.

In operation, the user will activate the handle 26 to pull on an end of the flush chain 30, thereby raising the flusher 34 so that the flush ball 40 rises up and away from the tank evacuation hole 20. This causes the water in the tank 10 to be evacuated through the pipe 22 causing a flushing of the toilet. As the water from inside the tank 10 is evacuated, the float 42 will descend, allowing the float seal 50 to be removed from the water inflow pipe 24, in turn allowing water to enter the interior of the tank 10. At this point, with the handle 26 released, the flusher 34 descends into position such that flush ball 40 sealably covers the hole 20. As the water flows into the interior of the tank 10, the water level will rise until the float 42 floats upwardly to a position suitable for the float seal 50 to sealably mount against the inflow pipe 24, thus shutting off the flow of water to the interior of the tank 10. In this operation, the flusher 34 may be aided if the flush ball 40 is weighted while flusher body 36 is hollow, providing suitable buoyancy to maintain the flusher 34 in a vertical position. Similarly, the guide 56, along with the flusher passage 58 and the float passage 60, also facilitates the appropriate movement of the flusher 34 and the float 42.

It will be appreciated by those skilled in the art that the conical bottom portion 14 of the tank 10, in cooperation with the configuration of the weighted flush ball 40, generally ensures a proper and nonleaking sealable mounting of the flush ball 40 over the tank evacuation hole 20, generally eliminating any water leakage through the hole 20.

Figure 3A:
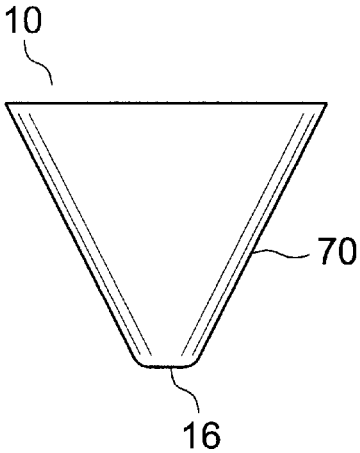
FIG. 3*a* is a front view of one possible embodiment of the present invention.
Figure 4A:
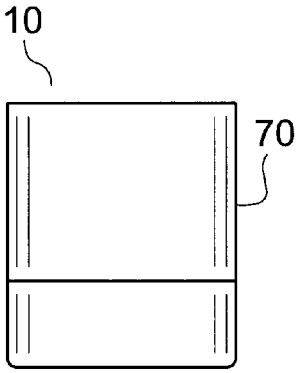
FIG. 4*a* is a front view of another possible embodiment of the toilet tank of the present invention.
Figure 5:
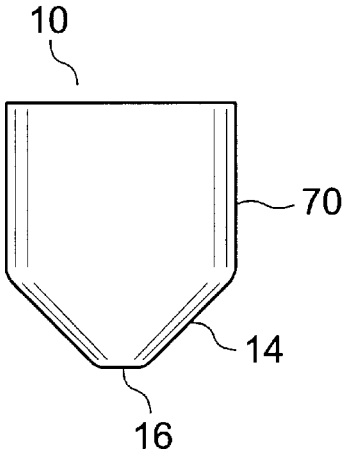
FIG. 5 is a front view of yet another possible embodiment of the present invention, whose side view would be the same view as that shown in FIG. 4*b* above which side view is therefore not repeated.
Figure 3B:
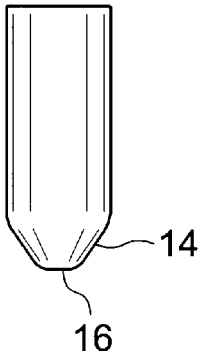
FIG. 3*b* is a side view of the toilet tank shown in FIG. 3*a;*

From the description above, in combination with FIGS. 3–5, it should be clear that the shape of the upper portion of the tank 10 is not critical so long as it has a bottom portion 14 which is generally conical to ensure that flush ball 40 is guided to sealably seat upon hole 20. Thus, the consumer can be presented with any appealing design for the toilet tank. It will be readily appreciated by one of skill in the art that the internal mechanisms described in detail above in connection with FIG. 1 may easily be mounted in the upper portion 70 of the tank 10, so long as the flusher 34 and the flush ball 40 are positioned to allow selective sealable mounting over the evacuation hole 20.

Figure 2:
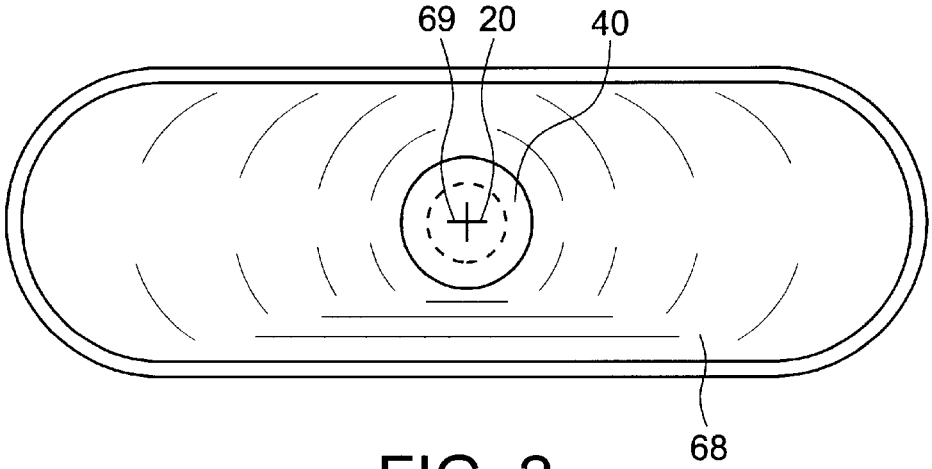
FIG. 2 is a top view of the toilet tank of FIG. 1.

FIG. 2 illustrates a top view of the tank 10. The flush ball 40 is shown covering the evacuation hole 20. The flush ball 40 also has a number of slots 69 configured to allow water to escape that enters through the top portion 36. The slots are configured to not inhibit the sealing of the tank 10, but to allow removal of overflow water. A ridge 68 may be formed to allow the tank to be mounted to an existing toilet.

Figure 4B:
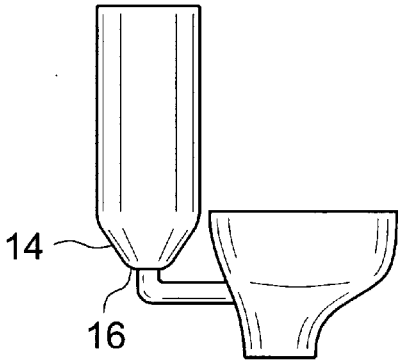
FIG. 4*b* is a side view of the embodiment shown in FIG. 4*a*.

As seen in FIG. 4*a*, the tank 10 of the subject invention can be configured such that the tank 10 has a generally rectangular front side as is now typical in the existing art. Thus, the present invention can be used with those desiring a more conventional tank configuration. As the side view of FIG. 4*b* shows, the cross sectional side view of bottom portion 14 can still be generally conical. In other words, the present invention is capable of functioning adequately where the bottom portion 14 is configured in a generally angular configuration, which may be truncated by the generally horizontally oriented base 16. Although the tank evacuation hole 20 as used in the embodiment illustrated in FIG. 4*b* could be circular, the hole 20 could also be elliptical to generally correspond to the angular base 16. Such a configuration will still work within the spirit of the present invention so long as the flush head 40 is configured in a complementary fashion to suitable and sealably mount over the hole 20. Again, the angle of the bottom portion 14 generally serves to ensure that the flush ball 40 is guided to sealably seat upon the hole 20.

Alternatively, the embodiment shown in FIG. 5*a* may present a generally rectangular top portion to the tank 10 while still presenting a generally conical bottom portion 14. Thus the front view illustrated in FIG. 5*a* shows a generally rectangular upper portion 70 while showing a triangular cross section of bottom portion 14. The side view of the embodiment illustrated in FIG. 5*a* would be similar to the side view shown in FIG. 4*b* and thus is not repeated here. Again, the bottom portion 14 of the embodiment shown in FIG. 5*a* is generally conical and will typically correspond with a circularly shaped tank evacuation hole 20, as was described in connection with FIG. 1. With the embodiments shown in FIGS. 3–5, any interior angles or ridges should be rounded (e.g., without seams) to prevent the buildup of mildew in the tank 10.

While the invention has been particularly shown and described with reference to the preferred embodiments thereof, it will be understood by those skilled in the art that various changes in form and details may be made without departing from the spirit and scope of the invention.

What is claimed is:

1. An apparatus comprising:

a toilet tank having a smooth inner surface and a formed bottom portion defining an evacuation hole;

a flusher comprising a hollow flusher body having a first end and a second end, wherein the second end comprises a flusher head configured to sink to the bottom of the tank after a flush to sealably cover the tank evacuation hole, wherein the first end and the second end are configured to allow an overflow of water to escape from the toilet tank;

an inlet configured to control water flow into the toilet tank, wherein the inlet is adjustable to control a rate of the water flow;

a guide mounted within the tank comprising a flusher passage and a float passage;

a float moveably disposed within said float passage, wherein said flusher is moveably disposed within said flusher passage and a water inlet pipe which ends within the interior of the tank, said float including a float seal to selectively, sealably seat against the end of the water inlet pipe.

2. The apparatus according to claim 1, wherein the flusher head is generally spherical.

3. The apparatus according to claim 1, wherein the flusher head is generally elliptical.

4. The apparatus according to claim 3, wherein said flusher head is weighted.

5. The apparatus according to claim 4, wherein said flusher head is weighted with a material more dense than water.

6. The apparatus according to claim 3, wherein said hollow flusher body is buoyant in water.

7. The apparatus according to claim 1, further comprising a handle pivotably mounted on the interior of the tank and a flusher chain having a first end attached to the flusher and a second end attached to the handle, wherein the handle is adapted to selectively remove the flusher head from a sealable seat on the evacuation hole.

8. The apparatus according to claim 1, wherein said tank further comprises a top portion.

9. The apparatus according to claim 8, where said top portion is rectangular and said bottom portion is angled.

10. The apparatus according to claim 1, where said bottom portion is formed such that water does not collect in said bottom portion when said evacuation hole is not sealed.

11. A method discharging water through selectively sealably seat upon a tank evacuation hole by:

providing a toilet tank having a smooth inner surface and a formed bottom portion wherein the tank evacuation hole is disposed within the bottom portion;

providing a flusher with a hollow flusher body, said flusher weighted with a material more dense than water, the flusher adapted to selectively sealably mount upon said hole, wherein the first end and the second end are configured to allow an overflow of water to escape from the toilet tank;

providing a guide mounted within the tank comprising a flusher passage and a float passage;

moveably disposing a float within said float passage wherein said flusher is moveably disposed with said flusher passage;

receiving water from an inlet pipe wherein said inlet pipe ends within the interior of the tank and said float includes a float seal to selectively, sealably seat against the end of said inlet pipe;

allowing the flusher to be guided by the bottom portion to seat upon the tank evaluation hole;

controlling a flow of water into the toilet tank; and adjusting a rate of said flow of water.

12. The apparatus according to claim 1, where said hollow flusher body allows an overflow of water to evacuate through said evacuation hole.

13. An apparatus comprising:

a toilet tank having a smooth inner surface and a formed bottom portion defining an evacuation hole;

a flusher comprising a hollow flusher body having a first end and a second end, wherein the second end comprises a flusher head configured to sink to the bottom of the tank after a flush to sealably cover the tank evacuation hole, wherein the first end and the second end are configured to allow an overflow of water to escape from the toilet tank;

an inlet configured to control water flow into the toilet tank, wherein the inlet is adjustable to control a rate of the water flow; and a handle pivotally mounted on the interior of the tank and a flusher chain having a first end attached to the flusher and a second end attached to the handle, wherein the handle is adapted to selectively remove the flusher head from a seatable seat on the evacuation hole.

14. The apparatus according to claim 13, further comprising:

a guide mounted within the tank comprising a flusher passage and a float passage; and a float moveably disposed within said float passage, wherein said flusher is moveably disposed within said flusher passage.

15. The apparatus according to claim 14 wherein a water inlet pipe ends within the interior of the tank and said float includes a float seal to selectively, sealably seat against the end of the water inlet pipe.

* * * * *